United States Patent [19]

Steingroever et al.

[11] Patent Number: 4,470,031

[45] Date of Patent: Sep. 4, 1984

[54] MULTIPOLAR MAGNETIZING DEVICE FOR PERMANENT MAGNETS

[76] Inventors: Erich Steingroever, Flensburger Strasse 33, 53 Bonn; Dietrich Steingroever, Bergisch-Gladbach, both of Fed. Rep. of Germany

[21] Appl. No.: 425,176

[22] Filed: Sep. 28, 1982

[30] Foreign Application Priority Data

Apr. 17, 1982 [DE] Fed. Rep. of Germany ..... 3214176

[51] Int. Cl.[3] ..... H01F 13/00

[52] U.S. Cl. ..... 335/284; 335/306

[58] Field of Search ..... 335/284, 302, 303, 306; 361/143, 147, 148

[56] References Cited

U.S. PATENT DOCUMENTS 3,158,797 11/1964 Andrews ..... 335/284

3,335,377 8/1967 Kohlhagen ..... 335/284

3,678,436 7/1972 Herdrich et al. ..... 335/284

*Primary Examiner*—George Harris

*Attorney, Agent, or Firm*—Fisher, Christen & Sabol

[57] ABSTRACT

A device for magnetizing multipolar permanent magnet bodies employs a supporting structure comprising a solid block, or a series of superimposed sheets, of electrically insulating material, which may be of fiberglass, with prepared apertures to receive the electrically conductive magnetizing winding; the apertures may be arranged to firmly support the winding to prevent displacement despite the strong magnetic fields generated by a high-current impulse discharge, and the winding can be arranged to produce a variety of polar patterns on flat magnets or, by providing a suitable opening in the supporting structure, on cylindrical magnets.

19 Claims, 8 Drawing Figures

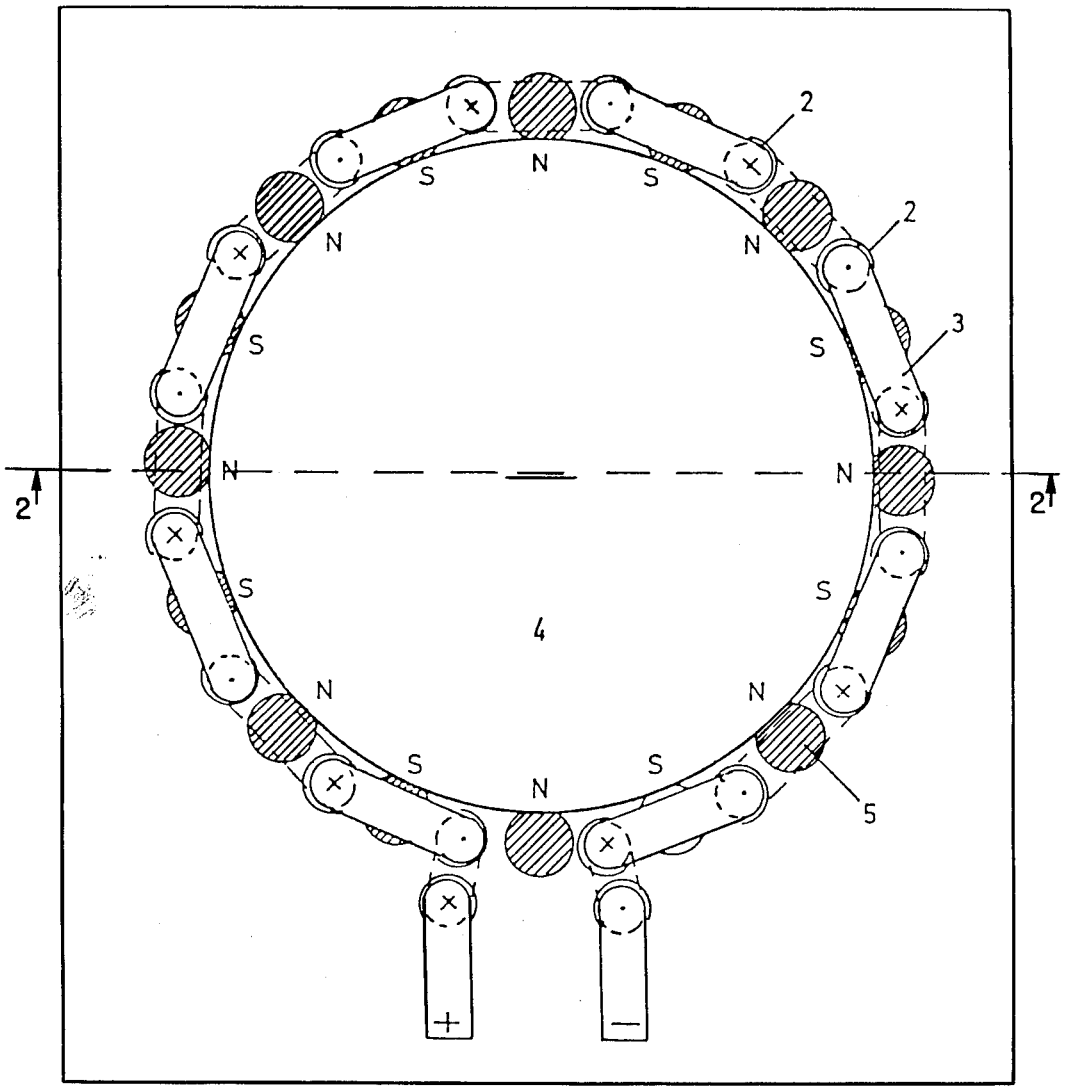
2
2
3
N
S
N
S
N
S

MULTIPOLAR MAGNETIZING DEVICE FOR PERMANENT MAGNETS

BACKGROUND OF THE INVENTION

The present invention concerns a multipolar magnetizing device for permanent magnets, which is used for the magnetization of highly coercive magnets, such as those made of Alnico, hard ferrite, or rare-earth-cobalt alloys.

Such magnets are known to be magnetized primarily with a high current pulse through a current conductor which is arranged opposite the surface of the magnet, corresponding to the desired number of poles and to the pole arrangement. Thus, it is possible to generate poles on the circumference of cylindrical permanent magnets or on flat surfaces, such as the end face of annular magnets.

Known magnetizing devices consist of a soft iron body with grooves which are arranged corresponding to the desired pole pitch and into which high-current conductors are inserted. These must be insulated adequately against the soft-iron conductor, whereby a considerable portion of the space of the grooves is occupied by the insulation in the case of narrow pole pitches. In addition, it is difficult to sufficently secure the current conductors against strong mechanical forces, such as by pouring plastic into the grooves.

BRIEF SUMMARY OF THE INVENTION

The present invention avoids these difficulties and makes it possible to prepare magnetizing devices in a simple manner even with a narrow pole pitch in which the poles are closely spaced.

The invention is characterized in that bores or apertures for the current conductors are provided in a body which corresponds to the shape of the magnet and consists of insulating material, corresponding to the desired pole pitch, and that the current conductor or current conductors are pulled firmly through these bores.

BRIEF DESCRIPTION OF THE DRAWINGS

FIG. 1 is a plan view of a preferred form of magnetizing device according to the invention for magnetizing a cylindrical permanent magnet;

FIG. 2 is a cross-section taken on the line 2—2 of FIG. 1;

A 16-pole magnetizing device for cylindrical magnets is shown as an example in FIGS. 1 and 2. Shown here are: a supporting body 1 in accordance with the present invention, which carries the current conductors and consists of insulating material, especially one that is reinforced with glass fibers, numeral 2 indicates a series of bores in the insulating body, which are distributed according to the desired pole arrangement, while numeral 3 indicates the high-current conductor wound in a meandering shape from + to −, which generates the poles N and S on the outer surface of a permanent magnet arranged in the cylindrical opening 4 provided in body 1 during current flow. Numeral 5 indicates cylindrical iron elements inserted into another series of bores in the insulating body 1, which are opposite to the poles to be produced and conduct and intensify the magnetic flux between the current conductors.

Figure 3:
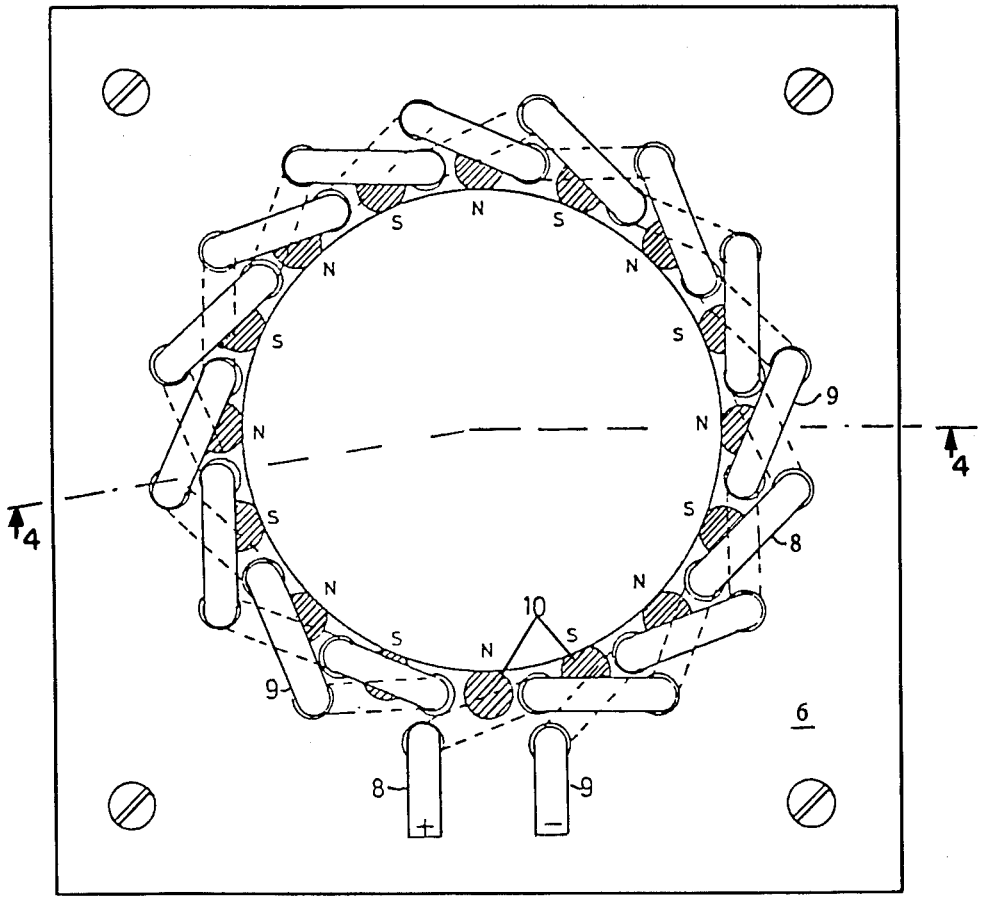
FIG. 3 is a plan view of a modified form of magnetizing device.
Figure 4:
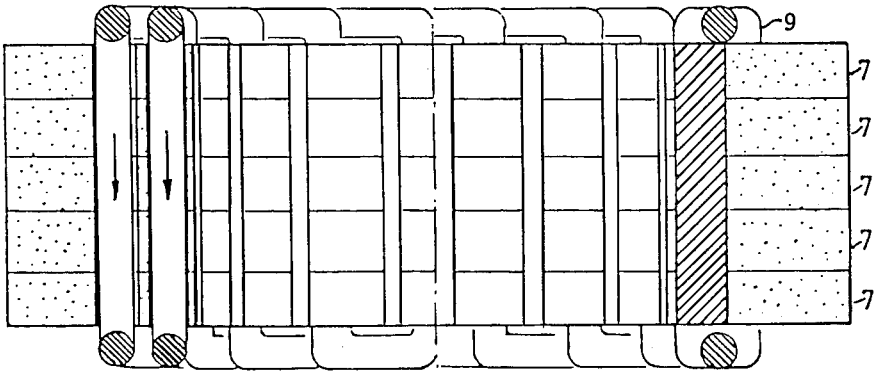
FIG. 4 is a cross-section taken on the line 4—4 of FIG. 3.
Figure 5:
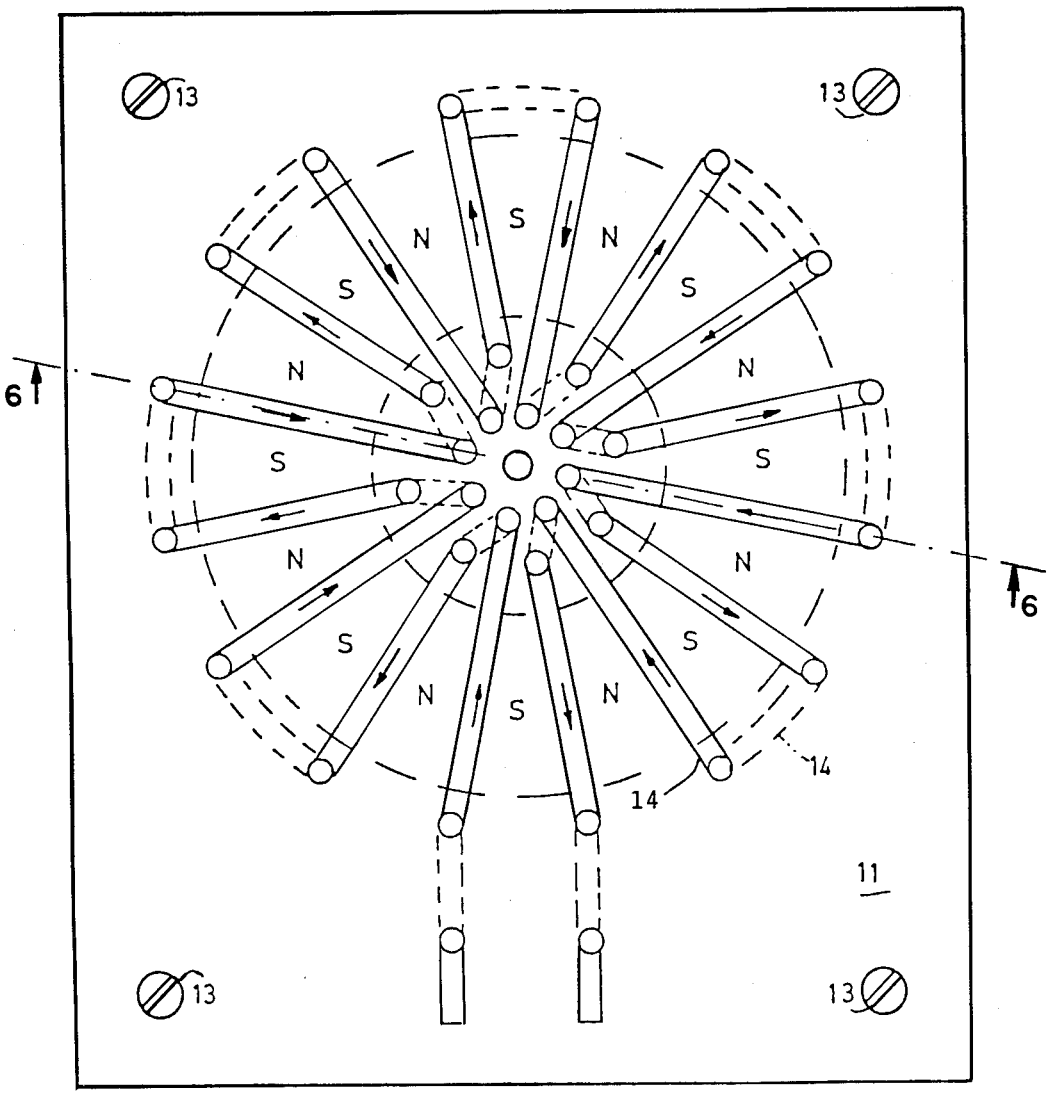
FIG. 5 is a plan view of a modified form of a device for producing sector-shaped poles on a flat surface.

Another example of the present invention is shown in FIGS. 3 and 4. Shown here are: an insulating body 6 composed of plates, or sheets, 7, in whose bores a forward meandering winding 8 and a return meandering winding 9 run. In this type of winding an axial field is avoided. The two partial windings are pulled through bores separated from one another, so that both are insulated thoroughly from one another with the result that the magnetizing device can be operated with high voltage in the range of 2,000 volts. The ends of the single winding are indicated by "+" and "−". If the structure of the winding-carrying insulating body is build up from a series of superimposed plates, or sheets, 7 in accordance with the present invention it is especially advantageous for magnetizing devices having long cylindrical magnets.

Iron elements 10 are arranged in bores between the current conductors in these magnetizing devices as well; they conduct and amplify the magnetic flux. As shown, they are concavely recessed slightly on the inside and form pole surfaces on the inner wall of the magnetizing device.

In accordance with the present invention, these pole pieces 10 can also consist of permanent magnetic material, so that a permanent pole arrangement is present and premagnetized magnets become oriented in the magnetizing device in such a way that their magnetization is enhanced by the current pulse.

In accordance with the present invention, the forward current conductor 8 can run only in the inner bores and the return current conductor 9 can run only in the outer bores of the insulating body. The return current conductor can have a larger cross-section than the forward one, so that the overall resistance of the winding is smaller than when the two parts of the winding have equal cross sections. Since the single current conductor of FIGS. 1 and 2 generates an axial magnetic field in addition to the radial field producing the poles on the magnet body it is possible to cancel out this axial field by providing the return winding 9.

Figure 6:
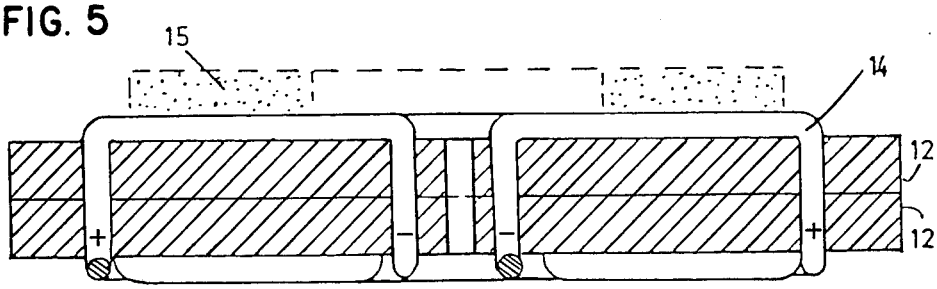
FIG. 6 is a cross-section on the line 6—6 of FIG. 5.

The device in accordance with the present invention for star-shaped, or sector-shaped, multipolar magnetization of a flat surface such as an end face of annular permanent magnets is shown in FIG. 6. The insulating body 11 which carries the winding, 14 is composed of plates, or sheets, 12 which are held together by the bolts 13, and carry the star-shaped winding 14 which again runs through bores of the insulating body in accordance with the present invention. Designated by numeral 15 is the annular permanent magnet to be magnetized, and the supply terminals are indicated by "+" and "−".

Figure 7:
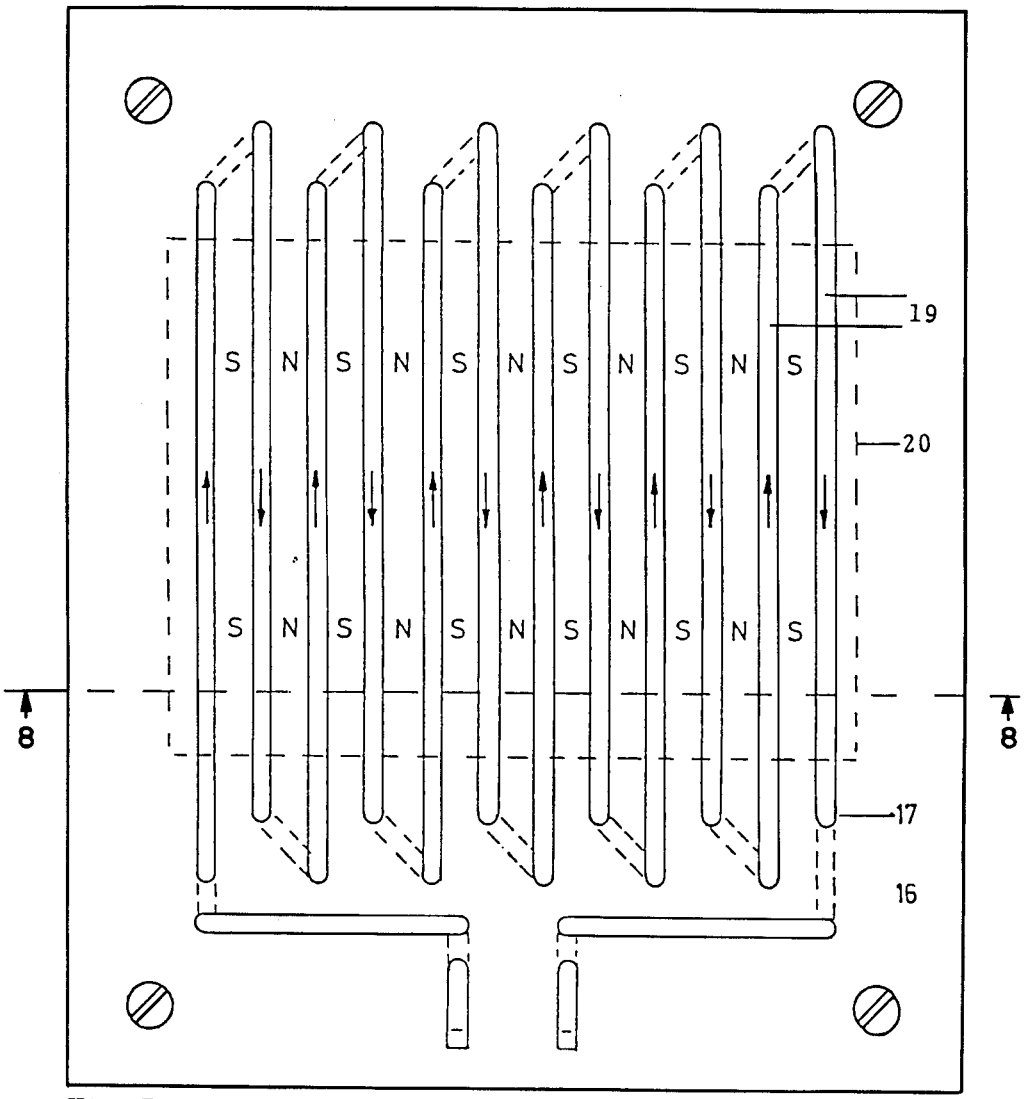
FIG. 7 is another modified form of a device for producing parallel poles on a flat surface.
Figure 8:
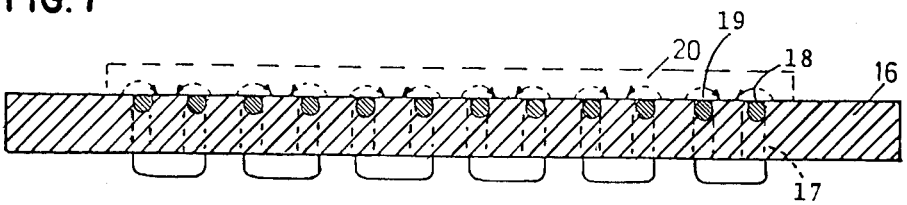
FIG. 8 is a cross-section taken on the line 8—8 of FIG. 7.

A magnetizing device as shown in FIGS. 7 and 8 can be prepared in accordance with the present invention for strip-shaped magnetization of permanent magnetic plates.

Bores 17 and grooves 18, through which the high-current conductor 19, which can be fastened by means of plastic adhesive if necessary, is led, are provided in a plate 16 made of insulating material. Strip-shaped poles N and S are generated by the current pulse on the surface of a permanent magnet 20. The magnetic flux in the plate is indicated in broken line in FIG. 8. This device permits for example, the strip-shaped magnetization of permanent magnet foils with a pole pitch of 1 mm, or less.

Two magnetizing devices of the type just described in connection with FIGS. 7 and 8, can be arranged opposite to one another like a waffle iron and can be connected electrically in parallel or in series for the simultaneous magnetization of foils or plates on both surfaces in accordance with the present invention.

What is claimed is:

1. A multipolar magnetizing device for producing magnetic poles of alternating polarity in a permanent magnet body, comprising:

a supporting body having a surface configured to closely conform with the surface of the magnet body to be magnetized;

said supporting body being composed entirely of electrically insulating material;

a plurality of conductors of low electrical resistivity spaced from each other to define magnetic poles between adjacent pairs of said conductors;

said supporting body having apertures extending therethrough;

each aperture receiving one of said plurality of conductors to prevent displacement of said plurality of conductors when energized by a high current electrical impulse, and;

means for connecting said plurality of conductors with a source of said electrical impulse so as to direct current in opposite directions through adjacent ones of the conductors defining said poles; said plurality of conductors being supported entirely by said supporting body; whereby alternating magnetic poles may be induced in a permanent magnet body without the use of a permanent magnet return path thus allowing use of very narrow poles in permanent magnet bodies having relatively small dimensions.

2. A magnetizing device as defined in claim 1, wherein said supporting body is provided with a circular opening extending from one side to the other to closely encircle a magnetic body having a cylindrical peripheral surface, said body being also provided with a plurality of parallel spaced apertures closely surrounding said opening, portions of said conductors extending through said apertures.

3. A magnetizing device as defined in claim 2, wherein said supporting body is also provided with a plurality of additional spaced parallel apertures closely encircling said opening, and ferromagnetic pole pieces disposed in said additional apertures.

4. A magnetizing device as defined in either one of claims 2 or 3, wherein a third plurality of apertures is provided in said supporting body, each of said third plurality of apertures being closely adjacent to and in parallel radial alignment with respective ones of said first mentioned plurality of apertures, and a second plurality of electrical conductors passing through said third plurality of apertures.

5. A magnetizing device as defined in claim 4, which includes electrical conductor means for connecting said first and said second plurality of conductors to a source of electrical energy to direct current through adjacent conductors of said first plurality of conductors in opposite directions and through the conductors of said second plurality of conductors in the same direction as in respective adjacent conductors of said first plurality of conductors.

6. A magnetizing device as defined in claim 1, wherein each of said conductors includes a magnetizing portion to be disposed adjacent to the surface to be magnetized, and a connecting portion which is angularly related to said magnetizing portion.

7. A magnetizing device as defined in claim 6 wherein each of said magnetizing portions is disposed within a respective one of said apertures.

8. A magnetizing device as defined in claim 6, wherein each of said connecting portions is disposed at least partially within one of said apertures.

9. A magnetizing device as defined in claim 8, wherein said supporting body comprises a flat surface, the magnetizing portions of said conductors being disposed over said flat surface and having connecting portions at each of their respective ends to prevent displacement of said magnetizing portions.

10. A magnetizing device as defined in claim 8, wherein said magnetizing portions are disposed within recessed portions of said supporting body to lie substantially flush with said flat surface.

11. A magnetizing device as defined in claim 8, wherein said connecting portions of the conductors also extend exteriorly of said body along the side opposite to said flat surface.

12. A magnetizing device as defined in any one of claims 9 or 11, wherein each of said conducting portions have one of their ends closely adjacent to each other at a common location, and extend radially outwardly from said common location to define generally triangular magnetic poles.

13. A magnetizing device as defined in any one of claims 9 or 11, wherein said conducting portions are disposed parallel to each other to define parallel magnetic poles.

14. A magnetizing device as defined in any one of claims 9, 10 or 11 wherein said supporting body comprises a plurality of superimposed flat sheets of electrically non-conductive material.

15. A magnetizing device for producing multipolar areas in a permanent magnet body comprising a supporting body having parallel opposite flat surfaces;

said supporting body being composed entirely of electrically insulating material;

said supporting body having a plurality of passages extending therethrough between said parallel surfaces;

a continuous elongated electrical conductor of low resistivity extending serially in opposite directions through selected ones of said passages from one side of the supporting body and between said passages on said opposite flat surfaces in a meandering path; predetermined portions of said conductor being disposed in a predetermined pattern to produce multipolar magnetic poles in said magnet body; said conductor being supported entirely by said supporting body; whereby alternating magnetic poles may be induced in a permanent magnet body without the use of a permanent magnet return path thus allowing use of very narrow poles in permanent magnet bodies.

16. A magnetizing device as defined in claim 15, wherein said supporting body is provided with an opening extending between the opposite flat surfaces to receive a magnetic body therein, said passages being arranged to position the predetermined portions of the conductor closely adjacent the surface of the magnetic body.

17. A magnetizing device as defined in claim 15, wherein said predetermined portions of the conductor are disposed along one of the flat surfaces of the supporting body.

18. A magnetizing device as defined in any one of claims 15, 16 or 17, wherein said supporting body comprises a plurality of superimposed flat sheets of electrically non-conductive material.

19. A magnetizing device as defined in claim 18, wherein said flat sheets comprise fiberglass material.

* * * * *